US007691004B1

(12) United States Patent
Lueders

(10) Patent No.: US 7,691,004 B1
(45) Date of Patent: Apr. 6, 2010

(54) GOLF PUTTER WITH ADJUSTABLE WEIGHT SYSTEM

(76) Inventor: Robert Lueders, 21545 W. 122 Ter., Olathe, KS (US) 66061

( * ) Notice: Subject to any disclaimer, the term of this patent is extended or adjusted under 35 U.S.C. 154(b) by 98 days.

(21) Appl. No.: 12/031,932

(22) Filed: Feb. 15, 2008

Related U.S. Application Data

(60) Provisional application No. 60/901,783, filed on Feb. 15, 2007.

(51) Int. Cl.
*A63B 69/36* (2006.01)
*A63B 53/04* (2006.01)

(52) U.S. Cl. ..... 473/222; 473/223; 473/233; 473/334; 473/340; 473/341; 473/255

(58) Field of Classification Search ..... 473/220–222, 473/251, 255, 233, 234, 334–339, 223–225, 473/340, 341, 349
See application file for complete search history.

(56) References Cited

U.S. PATENT DOCUMENTS

| | | | | |
|---|---|---|---|---|
| 3,888,492 | A * | 6/1975 | Cabot | 473/255 |
| 5,072,941 | A * | 12/1991 | Klein | 473/255 |
| 5,344,149 | A * | 9/1994 | Miller | 473/341 |
| 5,407,196 | A * | 4/1995 | Busnardo | 473/246 |
| 5,437,447 | A * | 8/1995 | Rigutto | 473/251 |
| 5,947,841 | A * | 9/1999 | Silvestro | 473/341 |
| 6,348,014 | B1 | 2/2002 | Chiu | |
| 6,641,487 | B1 | 11/2003 | Hamburger | |
| 6,896,625 | B2 | 5/2005 | Grace | |
| 2005/0215340 | A1 * | 9/2005 | Stites et al. | 473/233 |
| 2007/0155524 | A1 * | 7/2007 | Cameron | 473/251 |

* cited by examiner

*Primary Examiner*—Sebastiano Passaniti
(74) *Attorney, Agent, or Firm*—Mark D. Bowen, Esq.; Malin Haley DiMaggio Bowen & Lhota, PA

(57) ABSTRACT

An improved golf putter incorporating a weight management system that allows for adjustment of a golf club head weighting by incorporating an adjustable weight system wherein weights may be removed and replaced quickly and easily without requiring a specialized tool is disclosed. Weights received within weight ports formed in the heel and toe portions of the putter are maintained securely affixed within the club head body by plugs adapted for snap fit engagement with the club head. Unlike other putter weight adjustment systems disclosed in the art, the present invention does not require use of a special tool, such as a wrench, to remove and replace the weights. While the preferred golf club embodiment disclosed is a putter, the present invention contemplates incorporating any of the features and/or advancements disclosed herein into any golf club. In addition, the present invention further includes novel aspects relating to overall design, including mass distribution and a rearwardly projecting portion having an upwardly sloped sole that prevents the club from snagging the turf. Furthermore a hollowed out area formed within the rearwardly projecting portion is sized and shaped to receive a correspondingly sized and shaped sensing module adapted to measure club head movement and wirelessly transmit data to a remote graphical user interface.

3 Claims, 8 Drawing Sheets

GOLF PUTTER WITH ADJUSTABLE WEIGHT SYSTEM

CROSS REFERENCE TO RELATED APPLICATIONS

This application claims the benefit of provisional U.S. Patent Application Ser. No. 60/901,783, filed on Feb. 15, 2007.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

The present invention relates to the sport of golf, and more particularly to a golf putter having an adjustable weighting system and further adapted for use with a swing analysis system for analyzing the movement of a golf club.

2. Description of Related Art

The sport of golf is one of the most popular and fastest growing sports in the world.

Unfortunately, for both beginners and veterans of the game, it is one of the most difficult games to master. The key to the success of top golfers is that they have tremendous hand-eye coordination and the innate ability to swing a golf club in a way to maximize the ability to hit the golf ball with both power and accuracy.

Since most golfers are not born with such a talent, the only way to improve their swing is to practice individually or with professional help. The majority of players learn the game from a friend and develop their swing by trial and error on the golf course and at the driving range. However, learning the game in this manner can inhibit how good the player's swing can become. The player needs a way to analyze his or her swing after the swing has been made.

One golf club, however, has been the subject of more innovative efforts than the others, that golf club is the putter. Perhaps one reason why the putter has been the subject of so much innovation efforts is that its use accounts for half of the strokes allotted for a regulation round at par, namely two putts for every hole . . . not to mention the fact that golfer's routinely exceed two putts per hole.

A number of advancements in the golf putter art tend to relate to weight distribution and weight adjustability. For example, some golfers prefer a heavy putter, while others prefer a lighter putter. In addition, some golfers desire to adjust the weight of the putter depending on the conditions of the green, such as type of grass, condition of the green, undulation of the green, speed of the green, etc. For example, U.S. Pat. No. 6,641,487, issued to Hamburger, discloses an adjustably weighted putter wherein the body has a plurality of cavities formed therein for receiving weights to alter the weight characteristic of the club head upon removal of threaded fasteners. U.S. Pat. No. 6,896,625, issued to Grace, discloses a golf putter head incorporating removable weights such that the putter may be adapted between low swing weight, standard swing weight, and high swing weight configurations. Removal and replacement of the weights requires a specialized tool. U.S. Pat. No. 6,348,014, issued to Chiu, discloses a golf putter head and weight adjustable arrangement wherein the putter head body has a plurality of holes for receiving weights fastened by rubber retaining rings. Removal of the weights requires a screw rod or magnetic device.

The disclosures found in the prior art, however, fail to either teach or suggest a golf putter with adjustable weight system wherein the weights may be easily adjusted by removal and replacement of weights without the need for a special tool. The prior art further fails to disclose a golf putter that is both suitable for play while being adapted for use with an attachable swing analyzer. Accordingly there exists a need for an improved golf club, particularly a putter, adapted with an improved adjustable weight system and further adapted for use with an attachable swing analyzer.

BRIEF SUMMARY OF THE INVENTION

The present invention overcomes the limitations and shortcomings in the art by providing an improved golf putter incorporating a weight management system that allows for adjustment of a golf club head weighting by incorporating an adjustable weight system wherein weights may be removed and replaced quickly and easily without requiring a specialized tool. Weights received within weight ports formed in the heel and toe portions of the putter are maintained securely affixed within the club head body by plugs adapted for snap fit engagement with the club head. Unlike other putter weight adjustment systems disclosed in the art, the present invention does not require use of a special tool, such as a wrench, to remove and replace the weights. While the preferred golf club embodiment disclosed is a putter, the present invention contemplates incorporating any of the features and/or advancements disclosed herein into any golf club.

In addition, the present invention further includes novel aspects relating to overall design, including mass distribution and a rearwardly projecting portion having an upwardly sloped sole that prevents the club from snagging the turf. Furthermore a hollowed out area formed within the rearwardly projecting portion is sized and shaped to receive a correspondingly sized and shaped sensing module adapted to measure club head movement and wirelessly transmit data to a remote graphical user interface.

Accordingly, it is an object of the present invention to provide an improved golf swing analysis system.

Another object of the present invention is to provide such a system wherein specially designed golf clubs are provided, each having an area adapted for removably receiving a module containing accelerometers and a wireless transmitter.

In accordance with these and other objects, which will become apparent hereinafter, the instant invention will now be described with particular reference to the accompanying drawings.

DETAILED DESCRIPTION OF THE INVENTION

Figure 1:
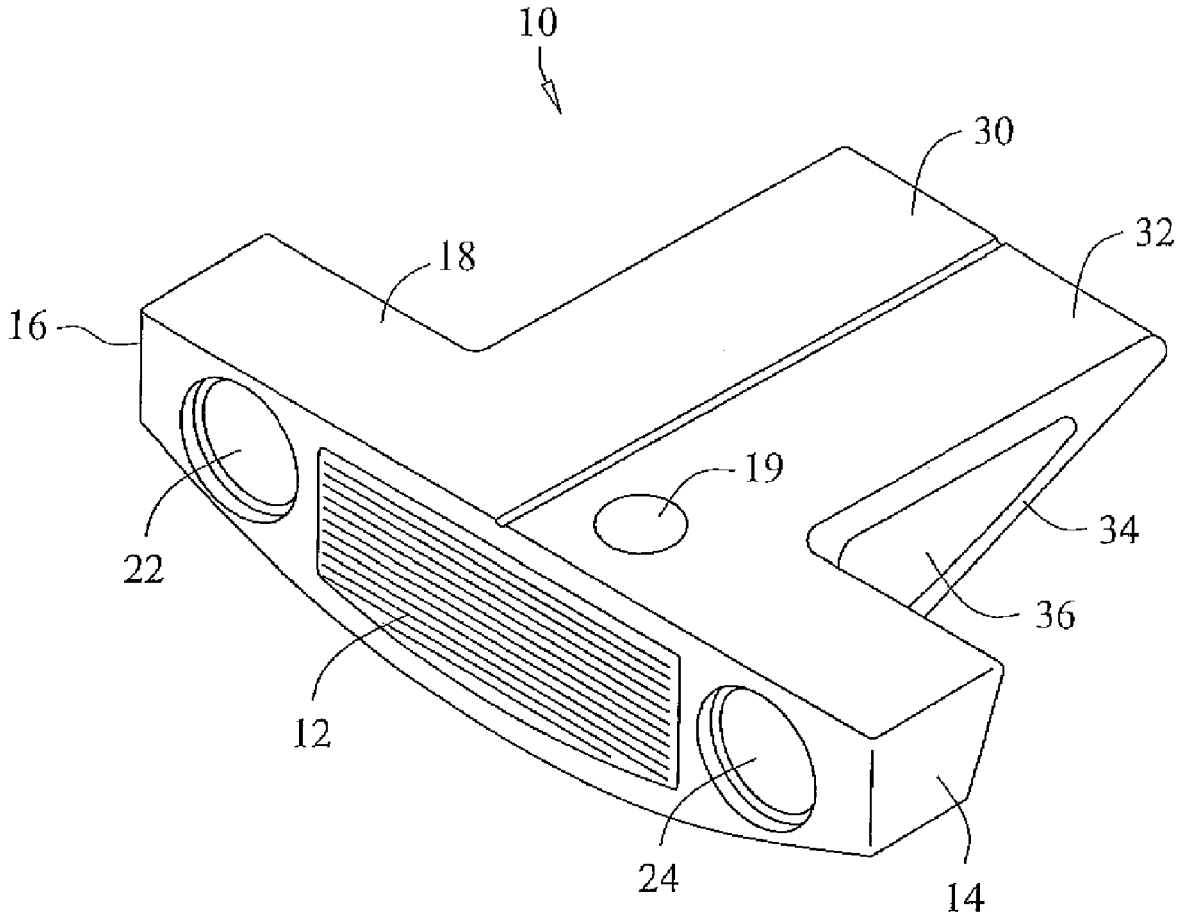
FIG. 1 is a top perspective view of a golf putter in accordance with the present invention.
Figure 2:
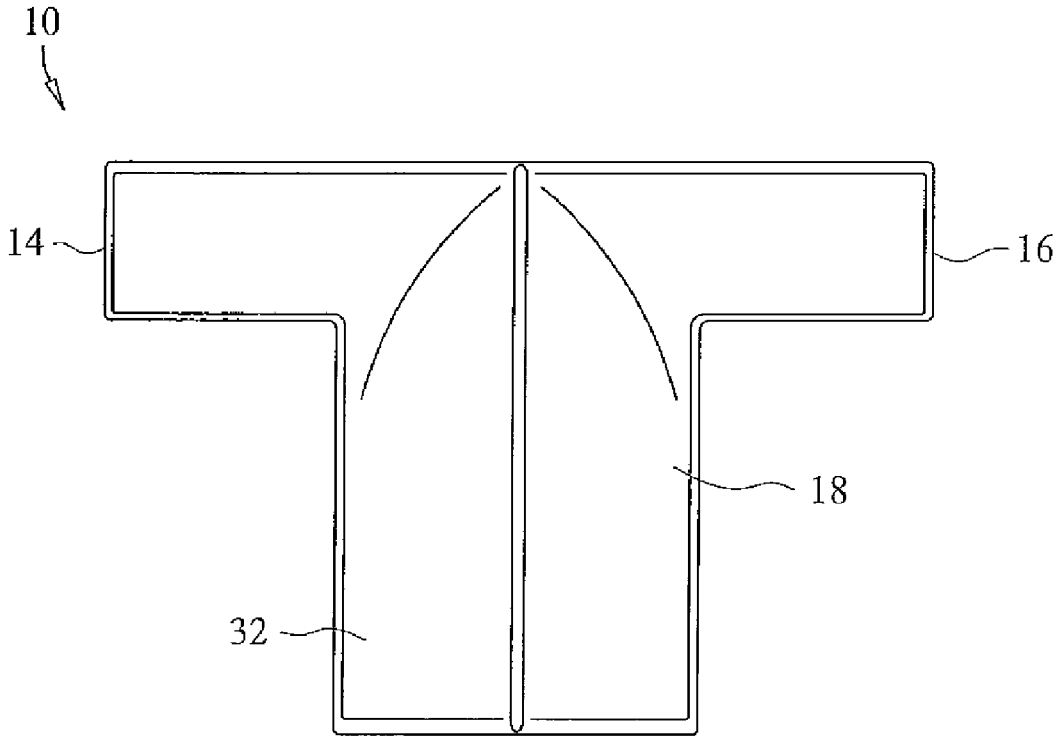
FIG. 2 is a top view thereof.
Figure 3:
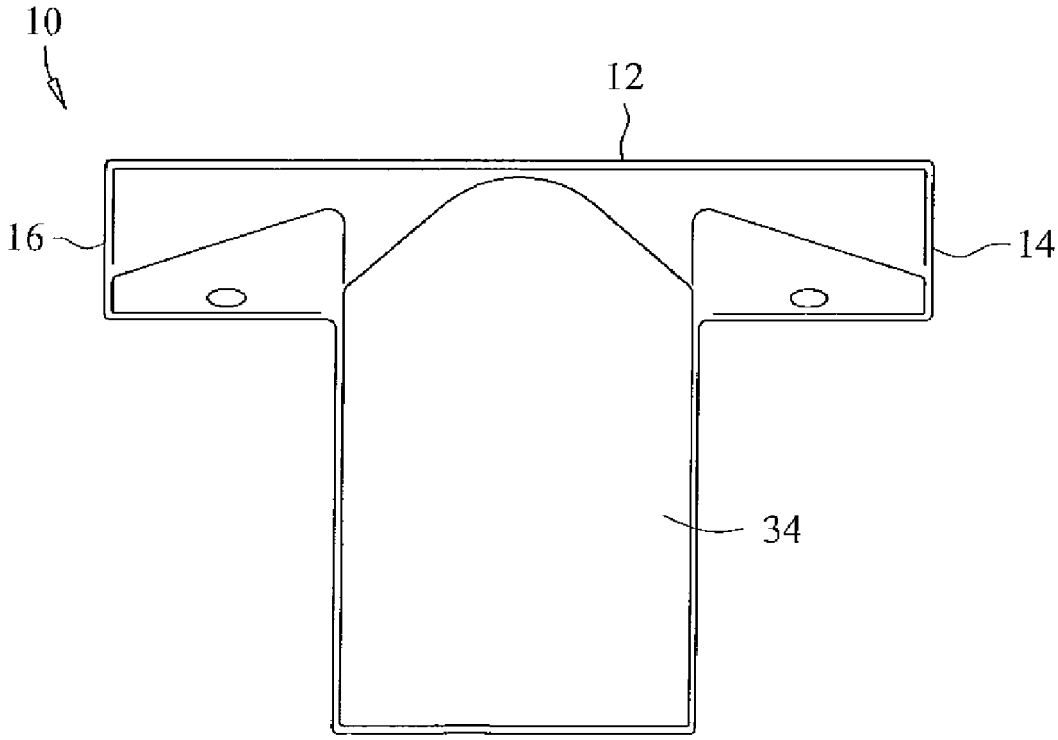
FIG. 3 is a bottom perspective view thereof.

With reference now to the drawings, FIGS. 1-13 depict a preferred embodiment of the present invention, namely, an improved golf putter head, generally referenced as 10, incorporating a weight management system that allows for adjustment of a golf club head weighting by incorporating an adjustable weight system wherein weights may be removed and replaced quickly and easily without requiring a specialized tool. Golf putter head 10 includes a to main body having a face portion 12, a heel portion 14, a toe portion 16, a top portion 18, a bottom portion or sole 20. Face portion 12 is preferably a milled planar surface within tight manufacturing tolerance, and may include horizontal grooves in accordance with the Rules of Golf as set forth by the United States Golf Association (USGA). In addition, face 12 may include an insert, such as SANTOPRENE® a material known for use with putters. SANTOPRENE® is a registered trademark of Advanced Elastomer Systems, LP, Akron, Ohio. In accordance with this embodiment, face 12 may include an insert that is flat or ribbed or with an overall convex curvature from top to bottom. In a preferred embodiment, face 12 has a slight loft as is typical with putters. In an alternate embodiment, however, face 12 may have negative loft (e.g. top edge ahead of bottom edge relative to the target line) to minimize backspin and/or impart top spin for more consistent rolling characteristics.

Face portion 12 defines weight-receiving ports in the toe and heel areas, namely a toe weight port 22 and a heel weight port 24. In a preferred embodiment, the toe and heel weight ports are offset to the upper half of the club (e.g. above a horizontal centerline). The positioning of the weight ports on the upper half of the club face allows the user to make weighting adjustments that effectively raise the center of gravity. This design feature is in contrast with conventional putter design norms wherein mass is distributed lower. The present inventor, however, In addition, a rear club head portion, generally referenced as 30, projects rearwardly from said main body. Rear portion 30 includes a top 32, a sole 34, and defines an opening 36. In addition, a shaft-receiving aperture 19 is formed in a suitable location on top portion 18 for mounting golf putter head 10 to a suitable shaft. The exact location of shaft-receiving aperture 19 may very to suit a particular golfer, such that the putter may be center shafted, conventionally heel shafted, or in any other suitable shaft configuration. Golf putter head 10 may be fabricated from steel, titanium, or any other suitable material, or combination of materials or alloys. Golf putter 10 may be fabricated by forging or casting process, and may be formed as a single unit or from individual components joined into a unitary club head.

Figure 7:
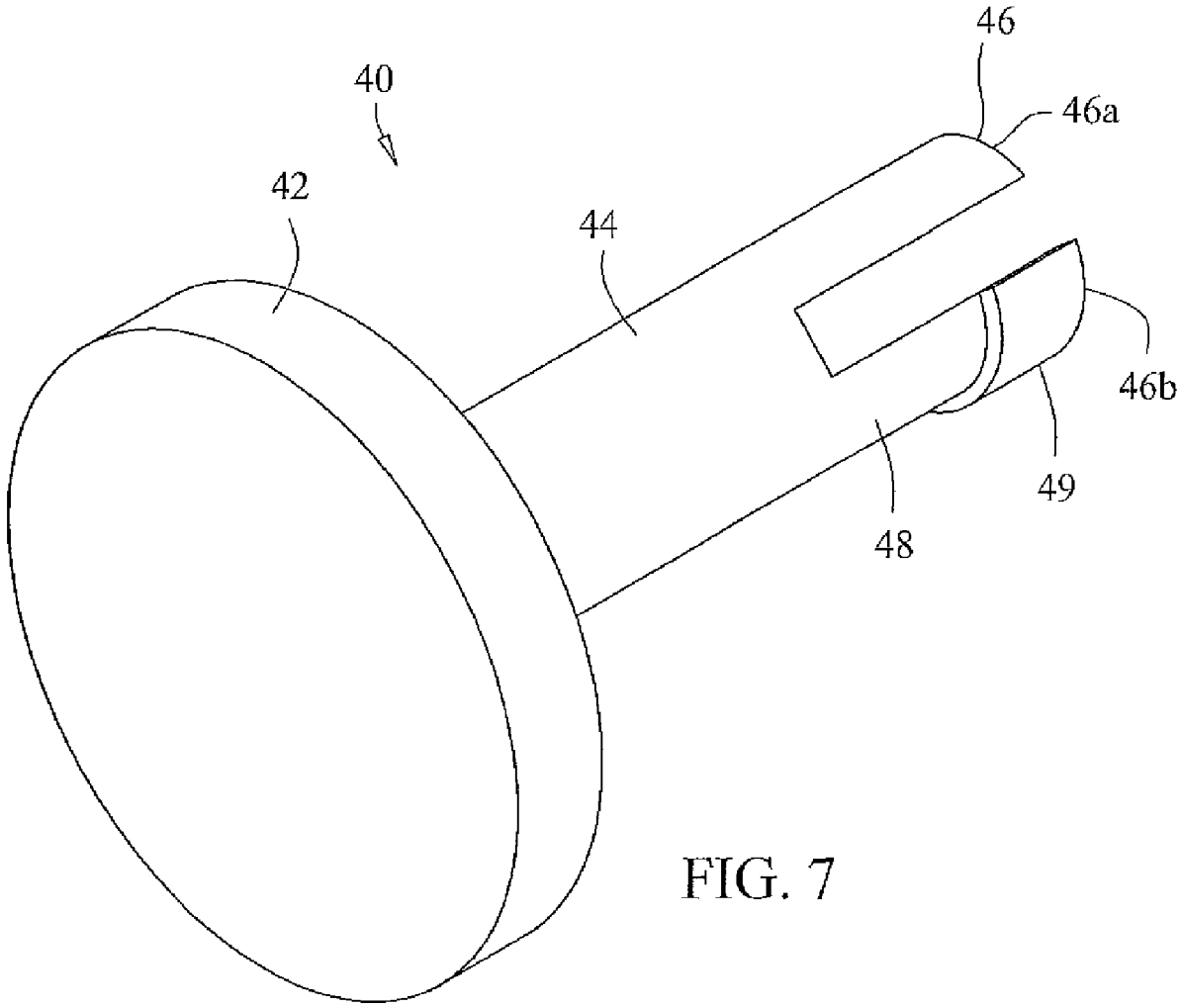
FIG. 7 is a perspective view of a plug for securing weights to the club head by snap-fit connection.

As discussed above, a significant aspect of the present invention relates to providing a golf putter adapted with an adjustable weight management system. In a preferred embodiment, weights (not shown) are removably received within weight ports 22 and 24 and are each similarly maintained securely affixed within the club head body by plugs 40, shown in FIG. 7, adapted for snap fit engagement with the club head. As best illustrated in FIG. 7, each plug 40 includes a radially enlarged first end 42 adapted to fit within one of the heel or toe ports 22 and 24 so as to be flush with face 12. Each plug further includes a cylindrical body 44 extending from first end 42 and terminating in a second end 46 having flexibly movable fingers 46*a* and 46*b* separated by a slot 48 and adapted with a projecting flange 49 defined on finger 46*b*. Plugs 40 may be simply removed manually by the user by application of force using only his/her fingers. Thus, unlike other putter weight adjustment systems disclosed in the art, the present invention does not require use of a special tool, such as a wrench, to remove and replace the weights. Plugs of differing weights or materials are provided to allow the user to customize weighting. As noted above, while the preferred golf club embodiment disclosed is a putter, the present invention contemplates incorporating any of the features and/or advancements disclosed herein into any golf club.

Figure 4:
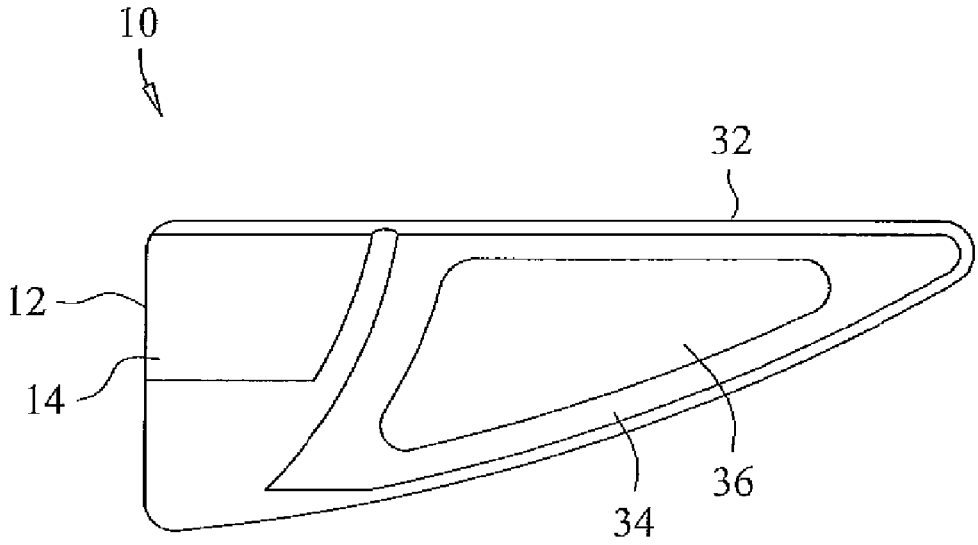
FIG. 4 is a side view thereof.
Figure 5:
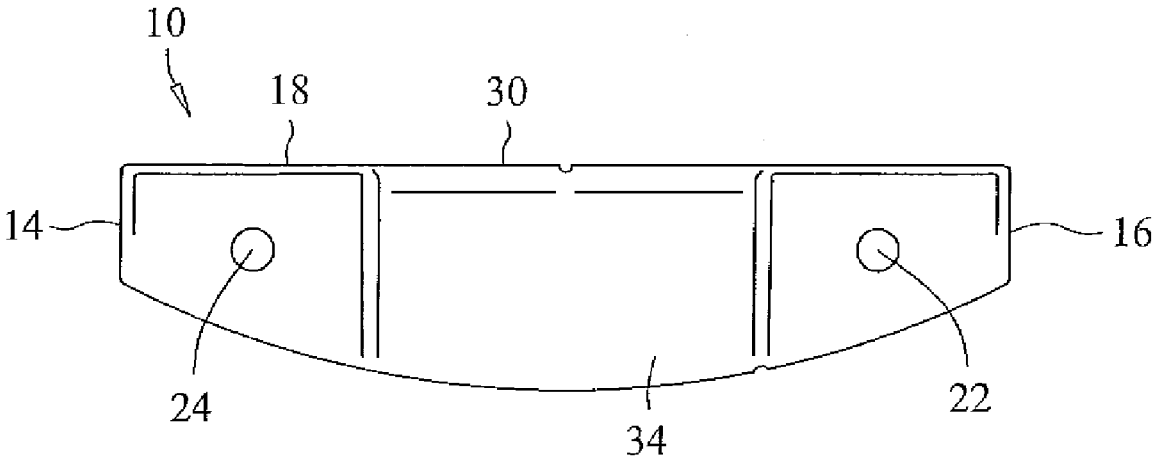
FIG. 5 is a rear view thereof.
Figure 6:
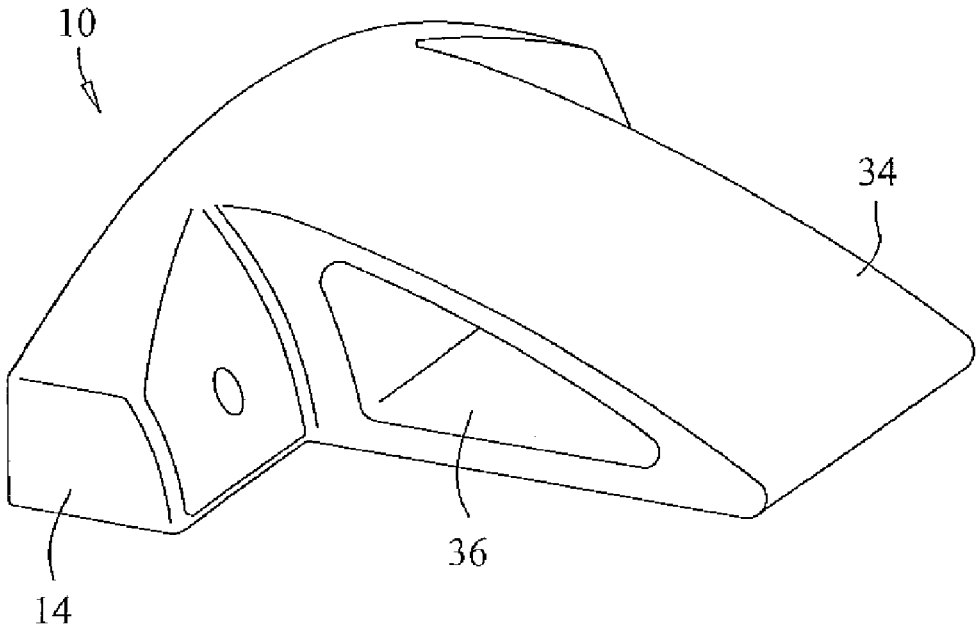
FIG. 6 is a bottom rear perspective view thereof.

In addition, the present invention further includes novel aspects relating to overall design of club head 10. More particularly, club head 10 includes a rearwardly projecting portion 30 having a top 32 and an upwardly sloped sole 34 extending from the back of face 12 in a to generally arcuate manner for mating with top 32 as best seen in FIGS. 1 and 4. A significant advantage presented by arcuate sole 34 is that it prevents the club from snagging the turf on the back swing, particularly for putts in proximity to the edge of the green where the grass transitions in height (e.g. the collar). This structure further relocates mass from the lower portion between the heel 14 and toe 16 areas to an elevated location thereby raising the center of gravity and moment of inertia. This configuration produces more top spin and has been found to start the ball rolling quicker on the green thereby helping to eliminate bouncing and skidding at the beginning of the roll associated with back spin. The rearwardly extending top portion 32 further provides desirable visual characteristics as the top presents the user with a "T-Square" shaped design to help the golfer properly square the face to the intended target line. The width of top portion 32 is preferably the same width as a golf ball because studies have shown the human brain picks up the outside shape of objects easier. The theory is similar to the 2 & 3 ball putters currently found in the market.

In addition, mass has been removed from the lower portion of the heel & toe to raise the center of gravity and also the moment of inertia. More particularly, a significant aspect of the present invention includes distributing the mass (e.g. weight) of the club head higher and forward. For example, the sole as seen at the bottom edge of face 12 is convexly shaped. The convex shape functions to move mass upward at the heel and toe thereby raising the center of mass. The removal of material from the heel portion 14 and the toe portion 16 also give the golfer the opportunity to rock the club towards or away from himself without raising the "sweet spot" thus giving the golfer a greater chance of contacting the sweet spot over other putter designs & making it more adaptable to different putting styles. Similarly, the convex sole 34 also functions to displace mass upward. The removal of material also helps prevent the club head from snagging the green surface (very short grass) on the backswing, and also helps to prevent grass (taller rough or first cut) from grabbing the club when on the fringe of the green up against the rough, in both the backswing and the downswing. Avoiding such contact with the grass along the fringe of a green is the reason many golfers attempt to contact the ball with the sole of the wedge in order to prevent the grass from grabbing and twisting the clubface.

With weights removed from the heel and toe weight ports 22 and 24 the putter becomes more of a center weighted putter. Additional contemplated embodiments include a center weight system in the very back on the bottom side to enhance the center weighted effect of the putter and to alter the moment of inertia ("MOI"). As should be apparent, however, adding heavier weights to weight ports 22 and 24 causes the putter to becomes more of a heel-toe weighted putter. This makes the putter more adaptable to different styles of putting (almost universal), therefore more people can use the benefits of the swing trainer/analyzer and still use this as their preferred putter for actual play.

Figure 8:
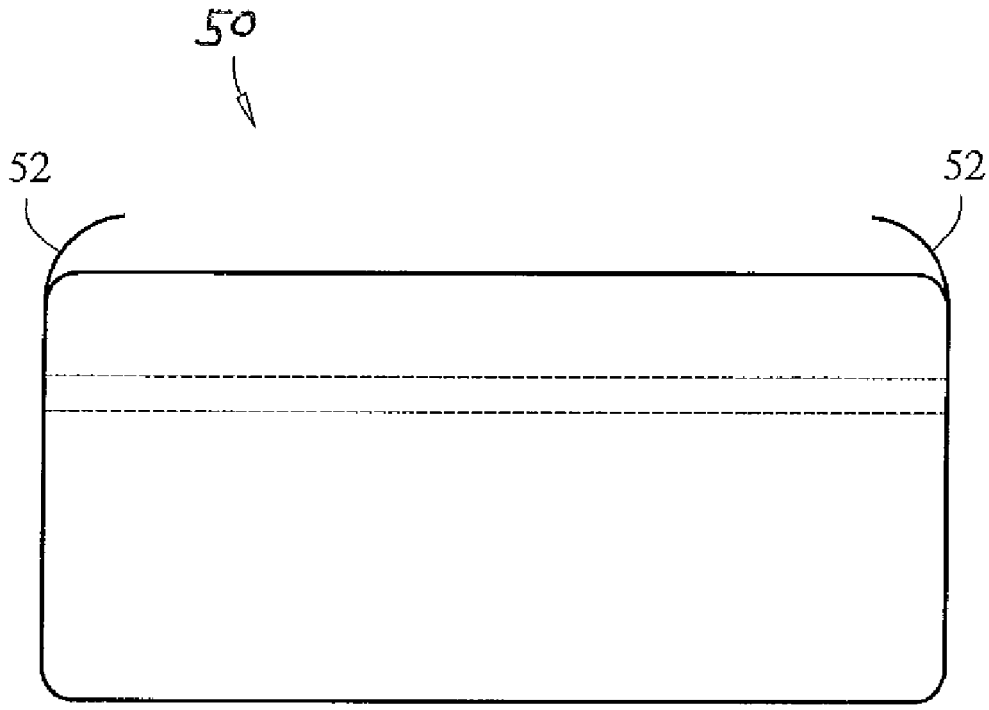
FIGS. 8-10 depict a sensing module in accordance with the present invention.
Figure 9:
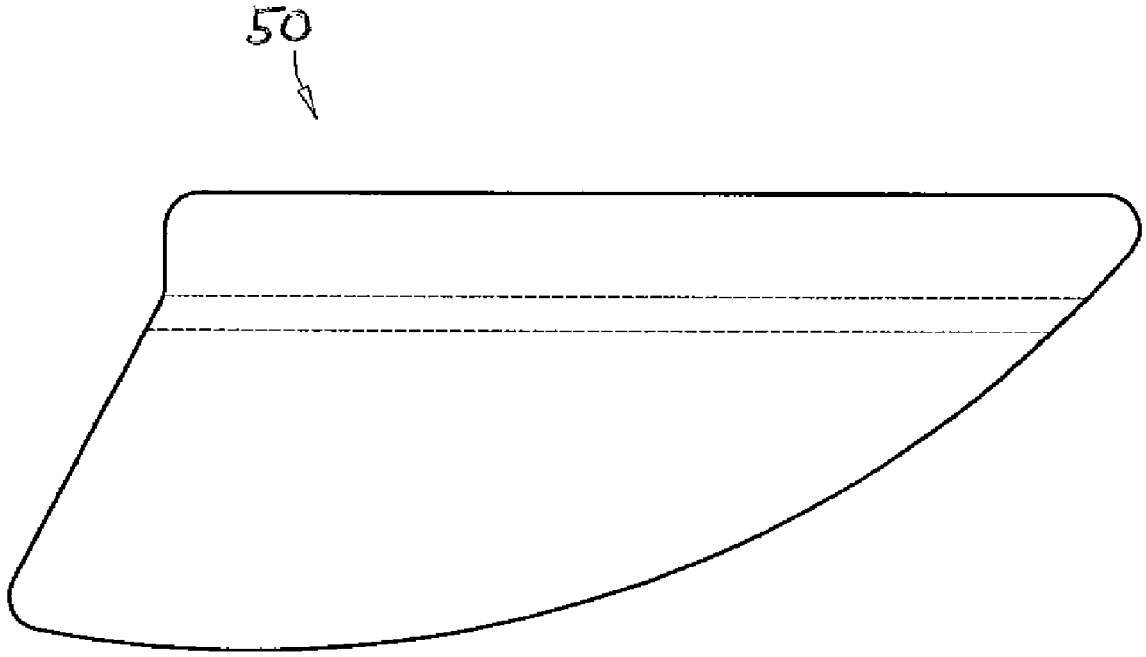
Figure 10:
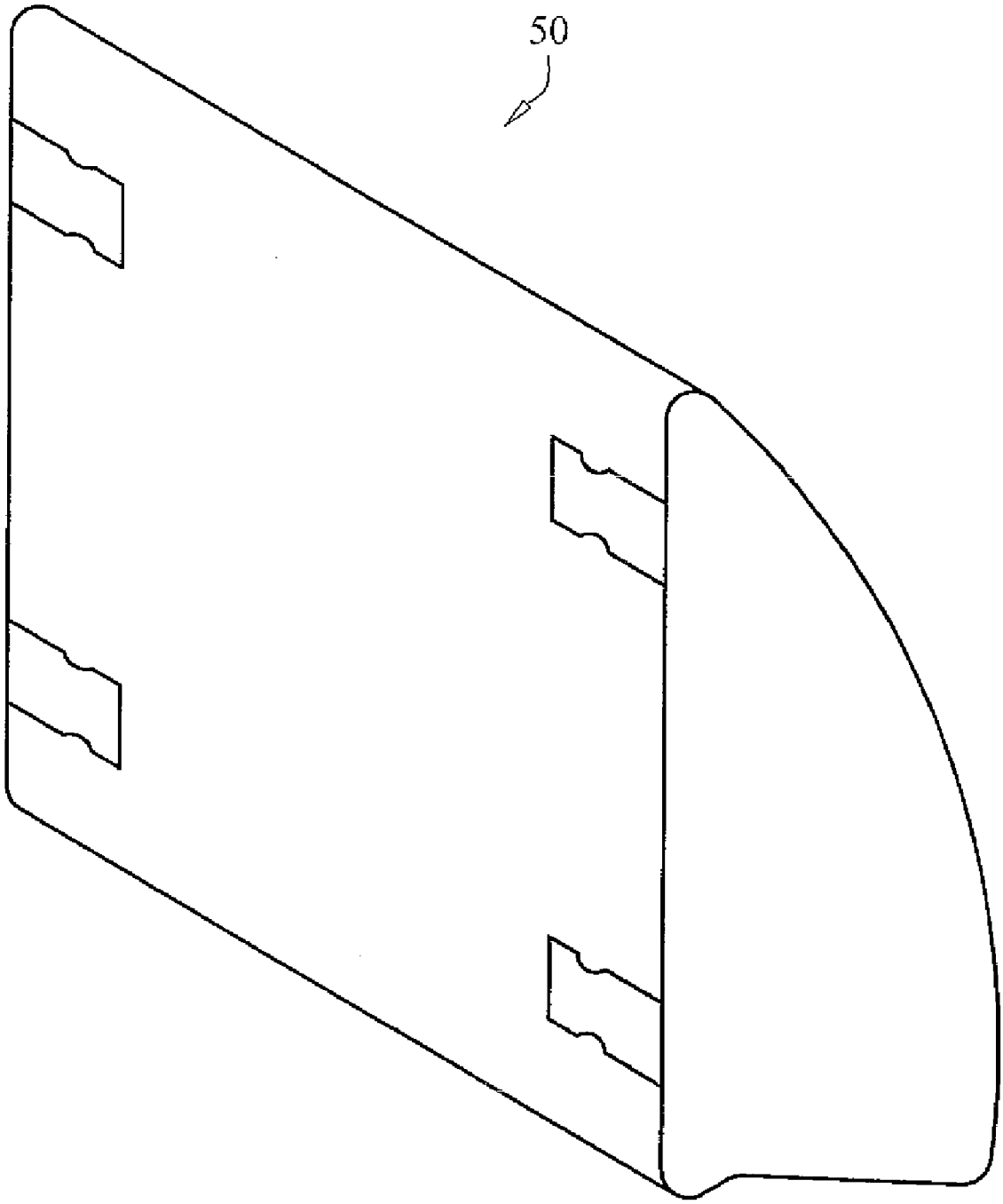
Figure 11:
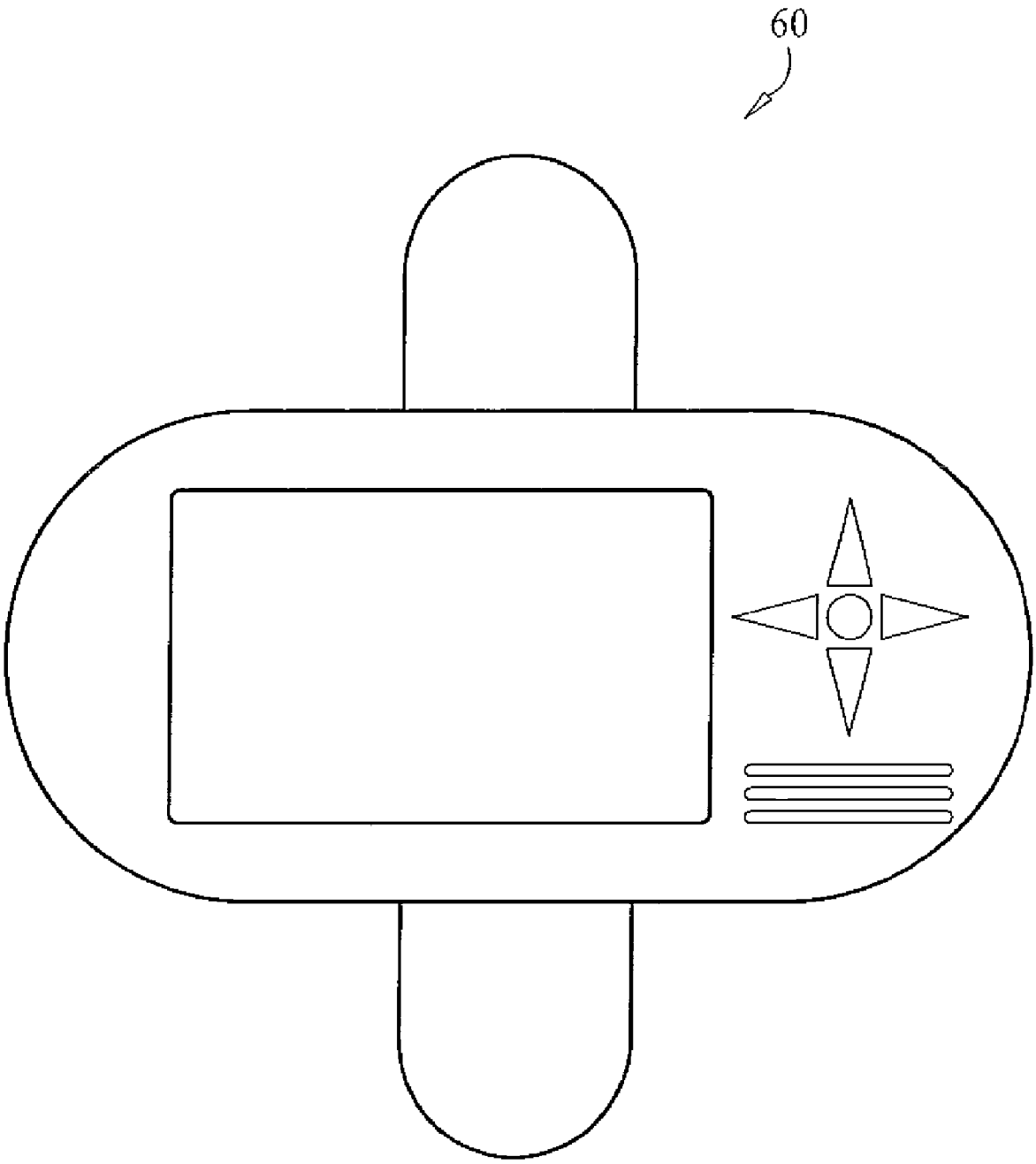
FIGS. 11-13 depict a wrist mounted graphical interface for receiving wireless transmissions from the sensing module.
Figure 12:
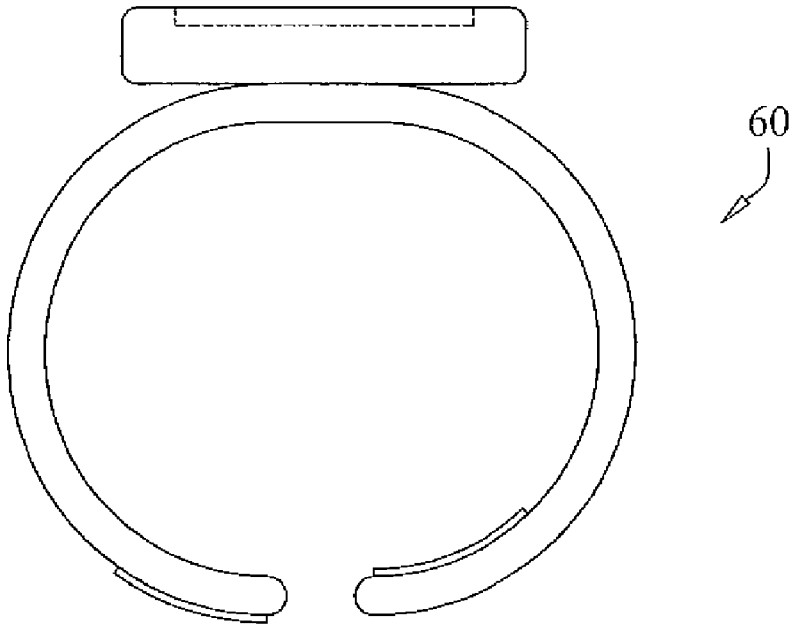
Figure 13:
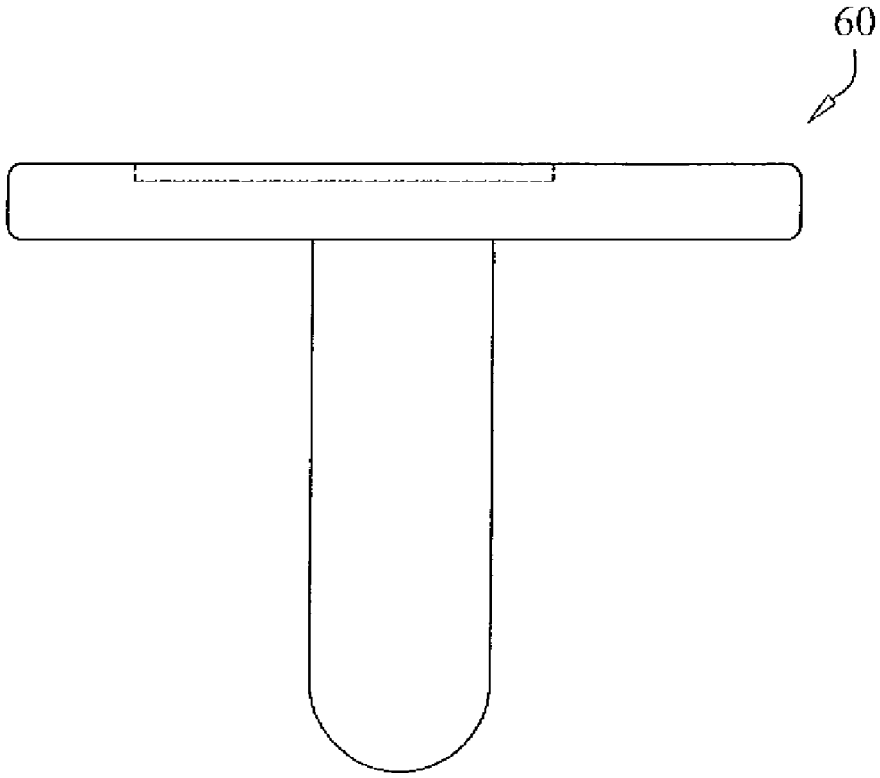

Still another novel aspect of the present invention includes providing a hollowed out area formed within the rearwardly projecting portion is sized and shaped to receive a correspondingly sized and shaped electronic sensing module adapted to measure club head movement and wirelessly transmit data to a remote graphical user interface. FIGS. 8-10 depict a sensing module 50 designed to fit within the hollowed out area 36. FIGS. 11-13 depict a preferred embodiment for a wrist mounted graphical user interface 60 for receiving information from sensing module 50.

Sensing module 50 thus also provides an improved low cost golf swing analyzer adapted for measuring club acceleration and swing path and transmitting data to a graphical user interface, such as wrist module 60, using IEEE802.15.4 ISM band wireless transmission. A suitable battery power supply (not shown) provides electrical power for operation. In the preferred embodiment, the putter head is adapted to include a cavity specifically sized and shaped for receiving an accelerometer containing housing securely, yet removably, mounted therein such that the outer dimensions and appearance of the club are not altered. Accordingly, sensing module 50 is preferably adapted with projecting levers 52 that function to engage the club head and secure the sensing module by press fit. The visual characteristics are very important for a golfer, and being able to use the swing analyzer without seeing it is a significant aspect of the present invention. In an alternate embodiment, the accelerometers and wireless transmitters are permanently incorporated into the clubs upon manufacture. By providing such a specially designed set of clubs, the present invention thus provides a swing analysis system that allows the user to obtain swing path and tempo information for each club in the bag.

Sensing module 50 includes a housing having outer dimensions corresponding to the cavities foliated in the various clubs to allow substantially the entire module to be received within the club head whereby the module is substantially concealed. Concealing the sensing module within the club head eliminates the possibility that the golfer's swing will be affected by changes in the appearance of the club. The housing is adapted for removable replacement, preferably by a snap-fit or press fit connection within the club head cavity as discussed above.

Sensing module 50 includes at least one 3-axis accelerometer and a gyroscope or electronic compass. An accelerometer is a device that measures its own motion, in contrast to a measuring motion by remote sensing. Providing a 3-axis accelerometer allows movement of the club to be measured in each of the three dimensions, namely X, Y, and Z. When combined with data obtained by the gyroscope, sensing module 50 generates a three dimensional model of club movement in terms of direction, acceleration, and velocity. The sensing module further includes a wireless transmitter for transmitting data obtained from the accelerometer and gyroscope to a processor. In a preferred embodiment, the wireless transmitter transmits data using the IEEE 802.15.4 ISM radio bands. The IEEE 802.15.4 wireless transmission system is significant as it provides a means for transmitting data at low power consumption thereby prolonging battery life, while further providing a transmitter of very low complexity and high reliability. The system is further capable of operating on any of 16 channels in the 2.4. GHz ISM band, 10 channels in the 915 MHz band, and one channel in the 868 MHz band. In addition, the present invention contemplates wireless communication using the 802.15.1 band, commonly identified with BLUETOOTH® technology. BLUETOOTH® is a registered trademark of BlueTooth Sig, Inc. Bellevue, Wash.

Data transmitted by the wireless transmission system is received by a graphical user interface 60. In accordance with a preferred embodiment of the present invention, the graphical user interface is comprises a wrist mounted electronic device that receives and processes the data to provide virtually instantaneous feedback. The feedback may result in the generation of graphical output on a display, or may result in the generation of audible output. In an alternate embodiment, the graphical user interface may be adapted to be worn on the body of user by a clip, belt, holster, or any other suitable means of attachment. The graphical user interface may be provided in various levels of integration. For example, a base unit may be provided with a black and white display, while more advanced units may be provided with a color display. Even more advanced units may be adapted with GPS, course layout, score card, the Rules of Golf, tips, and competitive and betting game management features. In addition, the graphical user interface may include a touch screen and be adapted to communicate in a wireless environment to enable communication between the user and the golf course management system to allow the user to order food and beverages, obtain weather warnings, post scores in real time for tournament and handicap purposes.

In accordance with another embodiment, the graphical user interface may be adapted to allow for the transfer of information to a personal digital assistant ("PDA"), laptop computer, tablet, or any other suitable electronic device. This embodiment achieves a number of enhanced uses for the data. For example, transferring the data to a computer allows for the data to be analyzed, manipulated, displayed, and shared. The data may also be electronically transmitted over the Internet to a third party for analysis. In addition, a golf instructor will be able to receive data for a number of students simultaneously.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A golf putter with an adjustable weight management system, said putter comprising:

a putter head having face having a heel portion, a toe portion, a top, and a sole;

said sole being convexly shaped between said toe portion and said heel portion;

said heel portion and said toe portion each defining a weight port;

at least one weight adapted for removable insertion within one of said weight ports;

said putter head including a rearwardly projecting portion disposed between said heel portion and said toe portion, said rearwardly projecting portion including a top and a bottom and defining an opening therebetween;

said rearwardly projecting portion top being generally planar;

said rearwardly projecting portion bottom being generally convex;

a sensing module including a housing shaped for removable insertion within said opening, said housing containing at least one 3-axis accelerometer, a gyroscope, a wireless transmitter;

an electronic device adapted to receive wireless transmissions from said sensing module, said electronic device configured to be worn on the human body.

2. A golf putter according to claim 1 wherein said electronic device adapted to receive wireless transmissions is configured to be worn on the wrist.

3. A golf putter according to claim 1 wherein said electronic device adapted to receive wireless transmissions provides audible output.

* * * * *